US009556880B2

(12) United States Patent
Gerard et al.

(10) Patent No.: US 9,556,880 B2
(45) Date of Patent: Jan. 31, 2017

(54) TURBINE EXHAUST SEAL

(71) Applicant: Honeywell International Inc., Morristown, NJ (US)

(72) Inventors: Arnaud Gerard, Epinal (FR); Shankar Pandurangasa Solanki, Bangalore (IN); Nicolas Morand, Deyvillers (FR); Sylvain Mulot, Benney (FR); Vincent Eumont, Thaon les Vosges (FR); Francis Abel, La Baffe (FR); Stephane Sibille, Thaon les Vosges (FR)

(73) Assignee: Honeywell International Inc., Morris Plains, NJ (US)

( * ) Notice: Subject to any disclaimer, the term of this patent is extended or adjusted under 35 U.S.C. 154(b) by 748 days.

(21) Appl. No.: 13/927,217

(22) Filed: Jun. 26, 2013

(65) Prior Publication Data

US 2015/0003957 A1 Jan. 1, 2015

(51) Int. Cl.

| | |
|---|---|
| ***F04D 29/10*** | (2006.01) |
| ***F01D 11/00*** | (2006.01) |
| ***F01D 17/16*** | (2006.01) |

(52) U.S. Cl.

CPC ..... *F04D 29/102* (2013.01); *F01D 11/003* (2013.01); *F01D 17/165* (2013.01); *F05D 2220/40* (2013.01); *F05D 2230/642* (2013.01); *F05D 2240/55* (2013.01); *F05D 2250/75* (2013.01)

(58) Field of Classification Search

CPC ..... F02C 7/28; F02C 6/12; F01D 17/14; F01D 17/148; F01D 17/16; F01D 17/165

USPC ..... 415/160

See application file for complete search history.

(56) References Cited

U.S. PATENT DOCUMENTS

| | | | | |
|---|---|---|---|---|
| 4,880,351 | A | 11/1989 | Inoue | |
| 5,146,752 | A | 9/1992 | Bruestle | |
| 7,351,045 | B2 | 4/2008 | Jinnai et al. | |
| 7,559,199 | B2 | 7/2009 | Sausse et al. | |
| 2006/0188368 | A1* | 8/2006 | Jinnai | F01D 17/165 415/191 |
| 2012/0263585 | A1 | 10/2012 | Matsuyama | |
| 2013/0084161 | A1 | 4/2013 | Groves et al. | |

FOREIGN PATENT DOCUMENTS

| | | | |
|---|---|---|---|
| DE | 102004039473 | A1 | 3/2006 |
| DE | 102011086310 | A1 | 5/2013 |
| EP | 0248624 | | 12/1987 |
| EP | 0433560 | A1 | 6/1991 |

(Continued)

OTHER PUBLICATIONS

European Search Report and Search Opinion, EP 14172035.9-1607, Oct. 1, 2014 (8 pages).

European Search Report, EP 14 15 3894, May 27, 2014 (4 pages).

*Primary Examiner* — Woody Lee, Jr.

(74) *Attorney, Agent, or Firm* — Brian J. Pangrle

(57) ABSTRACT

A turbine assembly for a turbocharger can include a C-shaped seal that includes an inner diameter, an outer diameter, an axis aligned parallel to a rotational axis of a turbine wheel, a lower lip that contacts a lower axial face of an outer surface of a shroud component along an annular portion of the shroud component, an upper lip that contacts a lower axial face of an inner surface of a turbine housing, and a wall portion that extends between the lower lip and the upper lip. Various other examples of devices, assemblies, systems, methods, etc., are also disclosed.

18 Claims, 9 Drawing Sheets

(56) References Cited

FOREIGN PATENT DOCUMENTS

| | | | | | |
|---|---|---|---|---|---|
| EP | 1691034 | A2 | | 8/2006 | |
| EP | 1691034 | A3 | | 8/2006 | |
| EP | 2180160 | A1 | | 4/2010 | |
| EP | 2243939 | A1 | | 10/2010 | |
| JP | 2010-112195 | A | | 5/2010 | |
| JP | 2010112195 | A | * | 5/2010 | |
| JP | 2011157841 | A | | 8/2011 | |
| WO | 2004022926 | A1 | | 3/2004 | |
| WO | 2004027218 | A1 | | 4/2004 | |
| WO | 2004109063 | A1 | | 12/2004 | |
| WO | 2013042554 | A1 | | 3/2013 | |
| WO | WO 2013042554 | A1 | * | 3/2013 | ..... F01D 11/005 |

* cited by examiner

TURBINE EXHAUST SEAL

TECHNICAL FIELD

Subject matter disclosed herein relates generally to exhaust turbines for turbochargers for internal combustion engines.

BACKGROUND

An exhaust system of an internal combustion engine can include a turbine wheel set in a turbine housing to create backpressure. In such a system, as the pressurized exhaust passes through the turbine housing (e.g., en route to an atmospheric outlet), the turbine wheel harnesses energy as the exhaust expands.

Various parameters may characterize a turbine wheel or a turbine housing. For example, a parameter known as "A/R" (e.g., area divided by radius) describes a geometric characteristic of a turbine housing where a smaller NR may increase velocity of exhaust directed to a turbine wheel and provide for increased power of a turbocharger at lower engine speeds (e.g., resulting in a quicker boost rise from a compressor). However, a small A/R may also cause exhaust flow in a more tangential direction, which can reduce flow capacity of a turbine wheel and, correspondingly, tend to increase backpressure. An increase in backpressure can reduce an engine's ability to "breathe" effectively at high engine speeds, which may adversely affect peak engine power. Conversely, use of a larger A/R may lower exhaust velocity. For a turbocharger, lower exhaust velocity may delay boost rise from a compressor. For a larger A/R turbine housing, flow may be directed toward a turbine wheel in a more radial fashion, which can increase effective flow capacity of the turbine wheel and, correspondingly, result in lower backpressure. A decrease in backpressure can allow for increased engine power at higher engine speeds.

As a turbine housing and turbine wheel can create backpressure in an exhaust system, opportunities exist for exhaust leakage. For example, during operation of a turbine, a turbine housing space is at a higher pressure than its environment. Also, since exhaust gas expands across a turbine wheel, pressure downstream of the turbine wheel is considerably lower than that of a turbine housing volute region. Hence, in the foregoing example, two possible regions may exist for exhaust leakage.

For example, exhaust leakage may be of a type that leaks out of an exhaust system to the environment or of a type that remains within an exhaust system yet bypasses a turbine wheel space. As to the latter, such leakage may occur between components of an exhaust turbine, for example, where the components may expand, contract, experience force, etc., as operational conditions vary. Further, where cycling occurs (e.g., as in vehicles), components may wear, become misaligned, etc., as cycle number increases. Whether external or internal, leakage can alter performance of a turbine wheel and turbine housing assembly. For example, a leaky turbine housing may not perform according to its specified A/R, which can complicate engine control, control of a variable geometry mechanism, etc. Various technologies and techniques described herein are directed to seals and sealing that can reduce leakage of exhaust, for example, within a turbine assembly.

BRIEF DESCRIPTION OF THE DRAWINGS

A more complete understanding of the various methods, devices, assemblies, systems, arrangements, etc., described herein, and equivalents thereof, may be had by reference to the following detailed description when taken in conjunction with examples shown in the accompanying drawings where.

DETAILED DESCRIPTION

Figure 1:
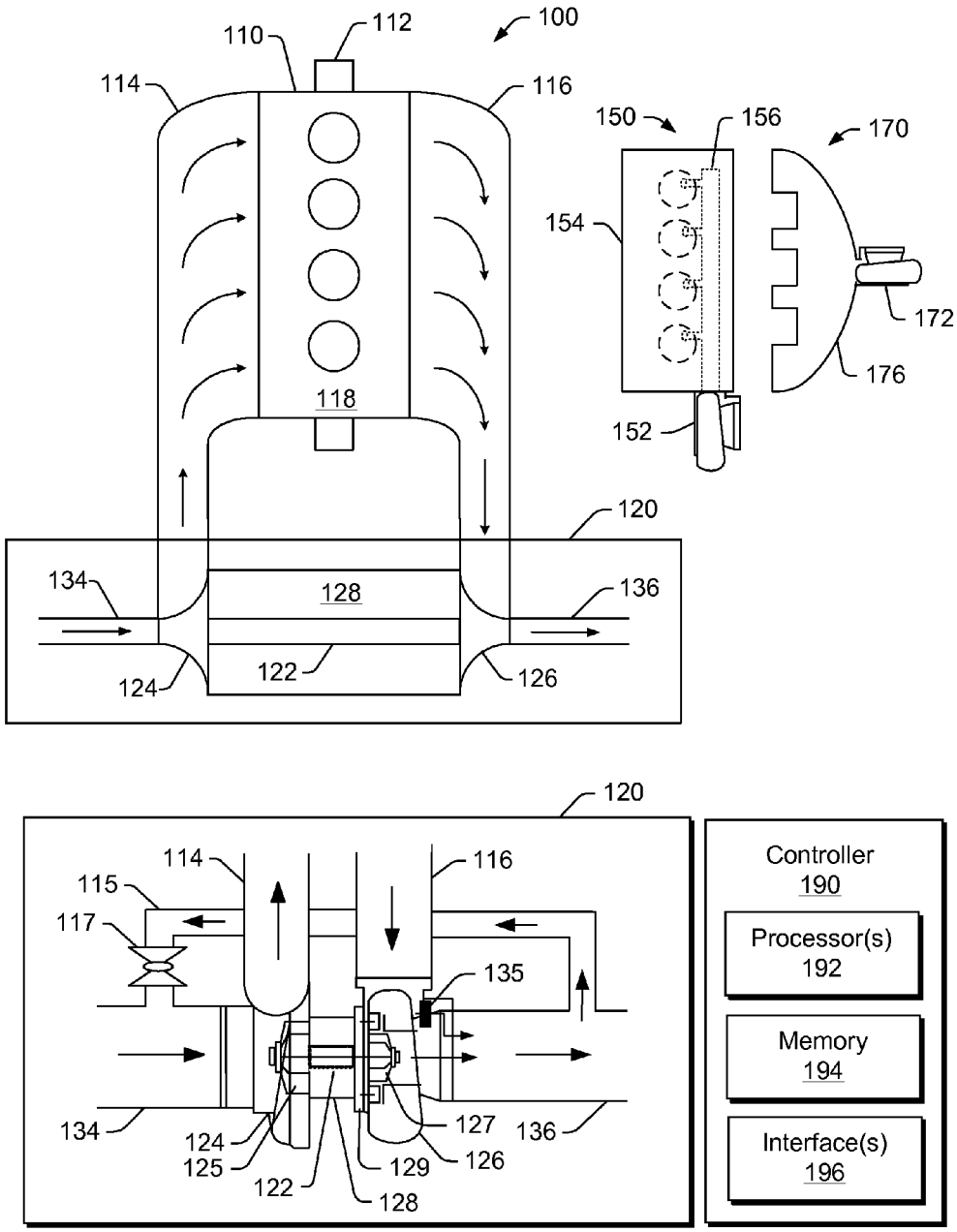
FIG. 1 is a diagram of a turbocharger and an internal combustion engine along with a controller.

As described in various examples, exhaust leaks may occur in a turbine assembly. For example, exhaust may leak between two components of a turbine assembly such that the leaked exhaust bypasses a turbine wheel space. Where the leaked exhaust passes from a volute of a turbine assembly to an outlet of the turbine assembly, without passing through a turbine wheel space, the efficiency of the turbine assembly may decrease. Where components of a turbine assembly expand, contract, experience force, etc., exhaust leakage may vary and make turbine performance less predictable. Where a turbine wheel drives a compressor wheel to charge intake air for an internal combustion engine, variations in exhaust leakage can impact predictability of engine performance.

As described herein, to mitigate exhaust leakage a turbine assembly may include a seal. For example, a turbine assembly for a turbocharger can include a turbine wheel with a base, a nose, blades, and a rotational axis that extends from the base to the nose; a turbocharger shaft operatively coupled to the turbine wheel; an annular component that includes an opening that receives at least a portion of the turbine wheel; a shroud component that includes an axis aligned with the rotational axis of the turbine wheel and an annular portion and a cylindrical portion that include an outer surface and an inner shroud surface where the outer surface includes a lower axial face and an upper axial face; mounts that extend from the annular component to locations at the shroud component where the mounts form an axial clearance between the annular component and the shroud component; a turbine housing that includes an axis aligned with the rotational axis of the turbine wheel, a lower axial face, an upper axial face and an inner surface that extends between the lower axial face and the upper axial face; and a C-shaped seal that includes an inner diameter, an outer diameter, an axis aligned parallel to the rotational axis of the turbine wheel, a lower lip that contacts the lower axial face of the outer surface of the shroud component along the annular portion of the shroud component, an upper lip that contacts the lower axial face of the inner surface of the turbine housing, and a wall portion that extends between the lower lip and the upper lip.

In the foregoing example, the seal may be deformable responsive to loading. Such deformability may allow the seal to seal a space between two components over a wide range of conditions. For example, a seal may deform responsive to force due to expansion or contraction of one or more components resulting from heating or cooling. As another example, a seal may deform responsive to axial thrust forces that occur during operation of an exhaust turbine (e.g., as in a turbocharger). As yet another example, a seal may deform in response to a load or loads applied to one or more components of a turbine assembly or a turbocharger assembly during an assembly process. In such an example, a bolt or other mechanism may be torqued according to a torque specification that results in a load (e.g., a "pre-load") being applied to a seal seated between two or more components of an assembly.

As an example, where a turbine assembly includes a shroud component, deformation of the shroud component may affect performance. For example, if an inner shroud surface deforms, a clearance or clearances between blades of a turbine wheel and the inner shroud surface may change. As an example, such changes may impact fluid dynamics of exhaust, which may decrease performance, increase noise, vibration, etc. In an assembly, a shroud component may be subject to various forces. For example, a seal may contact a shroud component and contact a turbine housing such that force applied to the shroud component is transmitted to the turbine housing via the seal. Depending on the stiffness of the seal, such force may act to deform the shroud component. The type of deformation, risk of deformation, etc. may depend on where such a shroud component is supported with respect to where it contacts such a seal. For example, where distances between locations of mounts that support a shroud component and contact locations of a seal with the shroud component increase, a risk of deformation may increase. As an example, a seal may be configured and located in an assembly to achieve distances between locations of mounts that support a shroud component and contact locations of the seal with the shroud component that act to reduce risk of deformation of the shroud component. For example, a seal may be configured with axially aligned upper and lower lips that contact a turbine housing and a shroud component respectively within a radial distance from a mount location (e.g., to more effectively transmit axial forces to a mount at that location). As an example, a seal may include a lower lip that is located axially closer to a mount location for a shroud component than an upper lip (e.g., the lower lip may be disposed at a radius greater than that of the upper lip). As an example, a seal may include an elongated C-shape, an offset C-shape (e.g., with radially offset upper and lower lips), or other shape that may include an upper lip, a lower lip and an inwardly curving wall between the upper lip and lower lip.

As a particular example, a seal may be positioned between a cartridge and a turbine housing of a variable geometry turbine assembly (e.g., consider a VGT assembly or a variable nozzle turbine "VNT" assembly). In such an example, the cartridge may include a shroud component and an annular component spaced axially by mounts where vanes are accommodated to control exhaust flow from a volute to a turbine wheel space. As an example, a vane may include a trailing edge and a leading edge with a pressure side airfoil and a suction side airfoil that meet at the trailing edge and the leading edge. Such a vane may have a planar upper surface and a planar lower surface where a clearance exists at least between the planar upper surface and the shroud component (e.g., between a lower planar surface of an annular portion of the shroud component). As an example, each vane may include an axis about which the vane may pivot (e.g., a pivot axis). As an example, each vane may include a post (e.g., or axel) that defines a pivot axis. In such an example, movement of a vane (e.g., arcwise) may be less closer to the pivot axis and greater further away from the pivot axis. For example, a trailing edge or a leading edge may be disposed a distance from the pivot axis such that upon pivoting of a vane, the leading edge and/or the trailing edge sweeps a maximum arc of the vane for a desired amount of pivoting. If clearance between an upper surface of a vane and a shroud component is diminished, the vane may bind, where the risk may increase depending on arc length as interaction area can increase with respect to arc length. In such an example, deformation to a shroud component may cause a vane or vanes to bind upon pivoting or even in a static position. Binding can result in loss of control, stress to a control mechanism, wear, etc.

As an example, a seal may be positioned in an assembly to reduce risk of deformation to a component such as a shroud component such that the seal can thereby reduce risk of vane sticking, binding, friction, etc. For example, where a shroud component is supported by mounts, a seal may contact the shroud component proximate to locations of such mounts on the shroud component. As an example, mount locations may be radially outward from a turbine wheel space (e.g., a shroud contour) as the mounts may interfere with exhaust flow, vane pivoting, etc. For example, as vanes may be shaped to provide a particular flow profile, locating mounts upstream (e.g., upstream of leading edges of the vanes) may have a lesser impact on flow to a turbine wheel space compared to locating mounts downstream (e.g., downstream of trailing edges of the vanes). In such an example, the shroud component may be supported near an outer radius (e.g., outer diameter), which may allow for flexing, deformation, etc. of portions interior thereto. Given such examples of constraints, a seal may be configured to contact a shroud component close to mount locations. Alternatively or additionally, a seal may be configured to contact a shroud component close to vane pivot axes such that force is transferred to a portion of a shroud component where vanes sweep smaller arcs.

As an example, another factor, which may give rise to a constraint, is the overhang of a turbine housing. For example, where a turbine housing has a small radial overhang (e.g., small annular lower axial face), an ability to position a seal toward a mount location or a vane pivot axis location may be limited.

While various examples of factors, constraints, etc. are described with respect to vane pivoting, shroud deformation, etc., a seal may likewise be constrained by factors as to sealing. As an example, a C-shaped seal may be configured for sealing as well as reducing risk of shroud deformation, for example, by including lower contact points that may be positioned radially outwardly from a cylindrical portion of a shroud component and where upper contact points may be directly, axially above the lower contact points or, for example, where lower contact points may be radially offset from the upper contact points (e.g., located radially outward from the upper contact points such that the upper lip is not axially above the lower lip). In such examples, the C-shaped seal may include a wall portion that extends radially inwardly from the upper and lower contact points, for example, to define a minimum diameter of the C-shaped seal. Such a wall portion may include a radius, for example, that allows for compression of a lower lip of the seal that forms the lower contact points with respect to an upper lip of the seal that forms the upper contact points.

As an example, a C-shape may be elongated, for example, to position contact points radially outwardly from a turbine wheel and more closely to, for example, shroud component mount locations. As an example, an elongated C-shape may be defined with respect to an aspect ratio. For example, a C height may be less than a C width such that the C-shape is elongated in width (e.g., width to height aspect ratio greater approximately one). As an example, an elongated C-shaped seal (e.g., a type of C-shape) may have a width to height aspect ratio greater than about 1.1. As an example, an elongated C-shaped seal may have a width to height aspect ratio of approximately 1.2. As an example, where one lip is at a diameter that is greater than another lip, the larger diameter may, for example, be used to define in part an aspect ratio (e.g., consider an elongated C-shaped seal with radially offset lips).

As an example, a seal may provide for a better stack up of components, for example, to reduce a turbine/cartridge differential expansion ratio leading to less compression/decompression of the seal. As an example, to locate a seal radially outwardly (e.g., closer to a mount, vane pivot axis, etc.), a seal may include an outer diameter that is a large percentage of a mount location diameter for a shroud component (e.g., approximately 75 percent or more). In such an example, contact area may also be increased, which may provide for a flexible seal configuration (e.g., seal shape). As mentioned, as an example, a C-shaped seal may be elongated and positioned radially outwardly between a shroud component and a housing; whereas, for example, if a seal is constrained to a smaller region (e.g., radially inward), elongation may not be possible or practical (e.g., it may be limited to a smaller width to height aspect ratio). As an example, a seal may provide for better localization of loading transmission (e.g., closer to spacers, mounts, etc.), for example, which for a given load may decrease the potential deformation of a shroud component (e.g., conical or other form of deformation). As an example, a seal may be configured and positioned to reduce bending force on a shroud component, a spacer, etc., for example, to help avoid flexure of the shroud component and, for example, binding of vanes.

As an example, a seal may act to maintain performance predictability of a turbine or turbocharger by withstanding bulk temperatures of approximately 800° C. and pressure differentials ($\Delta P_{max}$) of approximately 300 kPa. Such a seal may result in lower leak rates than a piston ring approach, which may have a leak rate of approximately 15 to approximately 30 l/min under a pressure differential of approximately 50 kPa. As an example, a seal may provide for lower stack-up limits (e.g., axial stack-up of components) and may comply with thermal evolution/growth during operation (e.g., and temperature cycling). As an example, a seal may be implemented without alteration to existing components (e.g., in terms of structure). For example, where a slot or slots exist for one or more piston rings, a seal may be positioned in a manner where the slot or slots do not alter sealing ability of the seal. As an alternative example, one or more components may be manufactured without machining or otherwise forming one or more slots.

As to pressure differentials and temperatures in a variable geometry turbine assembly, as an example, exhaust in a volute may have pressure in a range of approximately 120 kPa to approximately 400 kPa and possible peak pressure of up to approximately 650 kPa (absolute) and temperature in a range of approximately 200 degrees C. to approximately 830 degrees C. and possible peak temperature of up to approximately 840 degrees C.; whereas, at a location downstream blades of a turbine wheel, exhaust may have pressure in a range of approximately 100 kPa to approximately 230 kPa (absolute) and temperature in a range of approximately 100 degrees C. to approximately 600 degrees C. As described herein, as an example, a seal may be made of a material and be configured to withstand pressures and temperatures in such ranges. For example, a seal may be made of a material such as the INCONEL® 718 alloy (Specialty Materials Corporation, New Hartford, N.Y.). The INCONEL® 718 alloy includes nickel (e.g., 50-55% by mass), chromium (e.g., 17-21% by mass), iron, molybdenum, niobium, cobalt, aluminum and other elements. Some other examples of materials include INCONEL® 625, C263 (aluminum-titanium age hardening nickel), René 41 (nickel-based alloy), WASPALOY® alloy (age hardened austenitic nickel-based alloy, United Technologies Corporation, Hartford, Conn.), etc. As an example, a seal may be shaped via a stamping process (e.g., for shaping material provided as a sheet, optionally from a roll).

As an example, a seal may be configured for ease of assembly, optionally without any specialized jigs, tools, etc. As an example, upon assembly (e.g., at ambient or room temperature), a seal may be positioned between two or more components and loaded to exert a particular force on a cartridge (e.g., X N) in a first axial direction where another load may be applied to the cartridge (e.g., Y N) by another component in a second, opposing axial direction, for example, to help maintain axial location of the cartridge. In such an example, the load Y applied to the cartridge by the component exceeds the load X applied to the cartridge by the seal (e.g., $|Y|>|X|$). In such an example, the resulting load on the cartridge (e.g., at ambient or room temperature) may be determined as $|Y|$ minus $|X|$, in the direction of Y. The resulting load on the cartridge may help maintain its axial location in a turbine assembly (e.g., or in a turbocharger assembly). During operation, for example, where temperature and exhaust pressure are acting simultaneously, the load exerted by the seal may diminish and, in turn, the resulting load experienced by the cartridge may increase.

As an example, a seal may undergo a negligible level of plastic strain during operation (e.g., at an exhaust temperature of approximately 800 degrees C.). As to a duty cycle of a turbocharger, temperature may vary from approximately 200 degrees C. to approximately 800 degrees C. where load may vary correspondingly. As an example, a seal may offer near linear stiffness during thermal cycling (e.g., for an expected duty cycle).

Below, an example of a turbocharged engine system is described followed by various examples of components, assemblies, methods, etc.

Turbochargers are frequently utilized to increase output of an internal combustion engine. Referring to FIG. 1, a conventional system 100 includes an internal combustion engine 110 and a turbocharger 120. The internal combustion engine 110 includes an engine block 118 housing one or more combustion chambers that operatively drive a shaft 112 (e.g., via pistons). As shown in FIG. 1, an intake port 114 provides a flow path for air to the engine block 118 while an exhaust port 116 provides a flow path for exhaust from the engine block 118.

The turbocharger 120 acts to extract energy from the exhaust and to provide energy to intake air, which may be combined with fuel to form combustion gas. As shown in FIG. 1, the turbocharger 120 includes an air inlet 134, a shaft 122, a compressor housing 124 for a compressor wheel 125, a turbine housing 126 for a turbine wheel 127, another housing 128 and an exhaust outlet 136. The housing 128 may be referred to as a center housing as it is disposed between the compressor housing 124 and the turbine housing 126. The shaft 122 may be a shaft assembly that includes a variety of components. The shaft 122 may be rotatably supported by a bearing system (e.g., journal bearing(s), rolling element bearing(s), etc.) disposed in the housing 128 (e.g., a bore defined by one or more bore walls) such that rotation of the turbine wheel 127 causes rotation of the compressor wheel 125 (e.g., as rotatably coupled by the shaft 122).

In the example of FIG. 1, a variable geometry assembly 129 is shown as being, in part, disposed between the housing 128 and the housing 126. Such an assembly may include vanes or other components to vary geometry of passages that lead to a turbine wheel space in the turbine housing 126. As an example, a variable geometry compressor unit may be provided.

In the example of FIG. 1, a wastegate valve (or simply wastegate) 135 is positioned proximate to the inlet of the turbine 126. The wastegate valve 135 can be controlled to allow exhaust from the exhaust port 116 to bypass the turbine 126. Further, an exhaust gas recirculation (EGR) conduit 115 may be provided, optionally with one or more valves 117, for example, to allow exhaust to flow to a position upstream the compressor wheel 125.

FIG. 1 also shows an example arrangement 150 for flow of exhaust to an exhaust turbine housing 152 and another example arrangement 170 for flow of exhaust to an exhaust turbine housing 172. In the arrangement 150, a cylinder head 154 includes passages within to direct exhaust from cylinders to the turbine housing 152 while in the arrangement 170, a manifold 176 provides for mounting of the housing 172, for example, without any separate, intermediate length of exhaust piping. In the example arrangements 150 and 170, the turbine housings 152 and 172 may be configured for use with a variable geometry assembly such as the assembly 129 or, for example, other assemblies described herein.

In FIG. 1, an example of a controller 190 is shown as including one or more processors 192, memory 194 and one or more interfaces 196. Such a controller may include circuitry such as circuitry of an engine control unit. As described herein, various methods or techniques may optionally be implemented in conjunction with a controller, for example, through control logic. Control logic may depend on one or more engine operating conditions (e.g., turbo rpm, engine rpm, temperature, load, lubricant, cooling, etc.). For example, sensors may transmit information to the controller 190 via the one or more interfaces 196. Control logic may rely on such information and, in turn, the controller 190 may output control signals to control engine operation. The controller 190 may be configured to control lubricant flow, temperature, a variable geometry assembly (e.g., variable geometry compressor or turbine), a wastegate, an electric motor, or one or more other components associated with an engine, a turbocharger (or turbochargers), etc.

Figure 2:
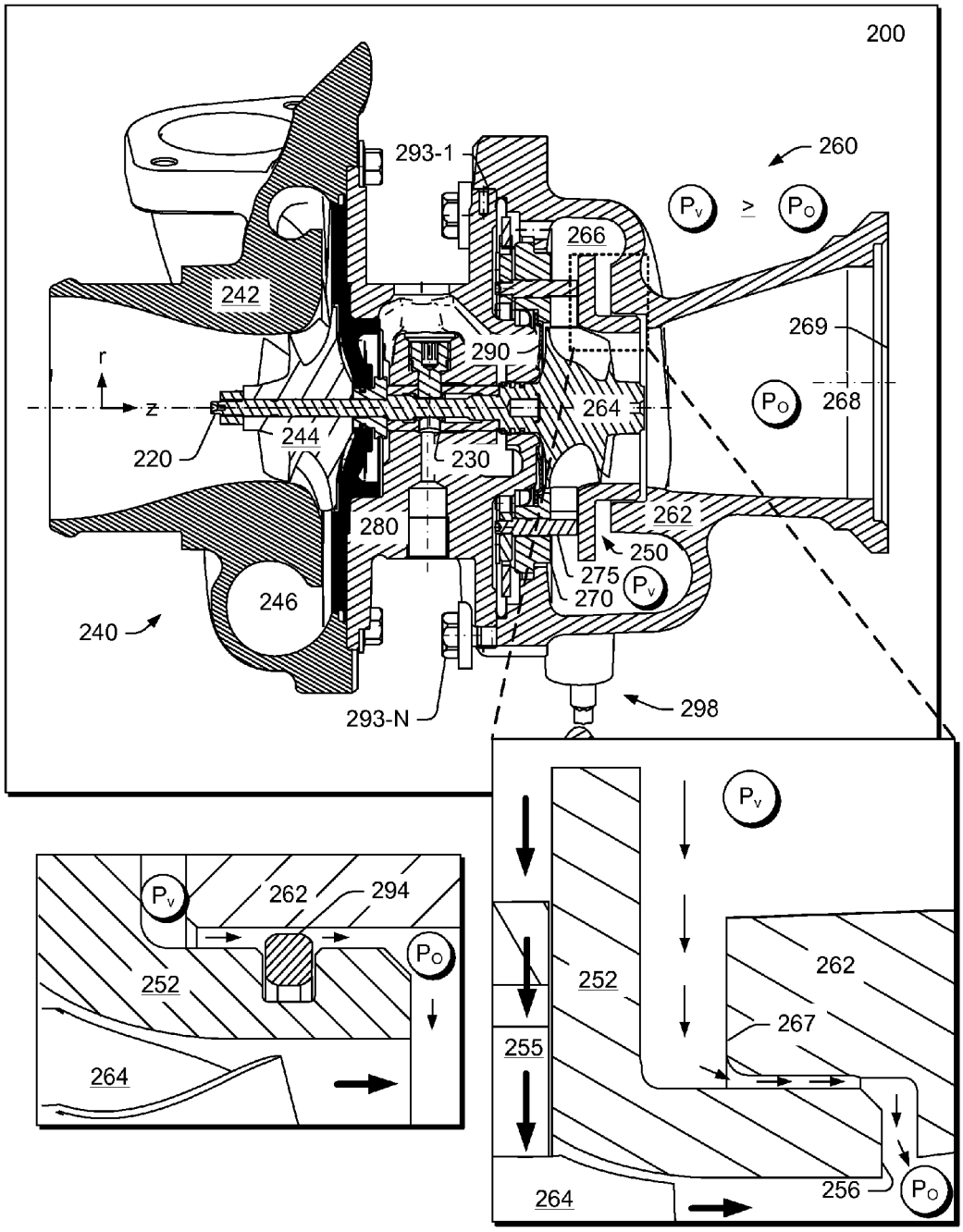
FIG. 2 is a series of cross-sectional views of an example of a turbocharger assembly.

FIG. 2 shows an example of a turbocharger assembly 200 that includes a shaft 220 supported by a bearing 230 (e.g., a journal bearing, a bearing assembly such as a rolling element bearing with an outer race, etc.) disposed in a bore (e.g., a through bore defined by one or more bore walls) of a housing 280 between a compressor assembly 240 and a turbine assembly 260. The compressor assembly 240 includes a compressor housing 242 that defines a volute 246 and that houses a compressor wheel 244. The turbine assembly 260 includes a turbine housing 262 that defines a volute 266 and that houses a turbine wheel 264. The turbine wheel 264 may be, for example, welded or otherwise attached to the shaft 220 to form a shaft and wheel assembly ("SWA") where a free end of the shaft 220 allows for attachment of the compressor wheel 244.

The turbine assembly 260 further includes a variable geometry assembly 250, which may be referred to as a "cartridge", that is positioned using a flange 270 (e.g., optionally shaped as a stepped annular disc) that clamps between the housing 280 and the turbine housing 262, for example, using bolts 293-1 to 293-N and a heat shield 290 (e.g., optionally shaped as a stepped annular disc), the latter of which is disposed between the cartridge 250 and the housing 280. As shown in the example of FIG. 2, the cartridge 250 includes a shroud component 252 and an annular component 270. As an example, one or more mounts or spacers may be disposed between the shroud component 252 and the annular component 270, for example, to axially space the shroud component 252 and the annular component 270 (e.g., forming a nozzle space).

As an example, vanes (see, e.g., a vane 255) may be positioned between the shroud component 252 and the annular component 270, for example, where a control mechanism may cause pivoting of the vanes. As an example, the vane 255 may include a vane post 275 that extends axially to operatively couple to a control mechanism, for example, for pivoting of the vane 255 about a pivot axis defined by the vane post 275. As an example, each vane may include a vane post operatively coupled to a control mechanism. In the example of FIG. 2, a clearance exists between an upper surface of the vane 255 and a lower surface of the shroud component 252. As mentioned, deformation of the shroud component 252 may diminish such clearance and, for example, have an effect on vane control.

As to exhaust flow, higher pressure exhaust in the volute 266 passes through passages (e.g., a nozzle or nozzles) of the cartridge 250 to reach the turbine wheel 264 as disposed in a turbine wheel space defined by the cartridge 250 and the turbine housing 262. After passing through the turbine wheel space, exhaust travels axially outwardly along a passage 268 defined by a wall of the turbine housing 262 that also defines an opening 269 (e.g., an exhaust outlet). As indicated, during operation of the turbocharger 200, exhaust pressure in the volute 266 ($P_V$) is greater than the exhaust pressure in the passage 268 ($P_O$).

As shown in two enlarged views of the example of FIG. 2, a clearance exists between the turbine housing 262 and the cartridge 250. Specifically, a clearance exists between a surface 256 of the shroud component 252 of the cartridge 250 and a surface 267 of the turbine housing 262. As mentioned, a piston ring approach to sealing a passage formed by a clearance can involve positioning a piston ring in a slot. The enlarged views of FIG. 2 show an example without a piston ring (lower right) and another example with a piston ring 294 positioned in an effort to seal such a passage (lower left). As described herein, a seal may be used in an effort to seal such a passage. Depending on size, shape, orientation of a seal in an assembly, a piston ring may optionally be included to assist with sealing.

Figure 3:
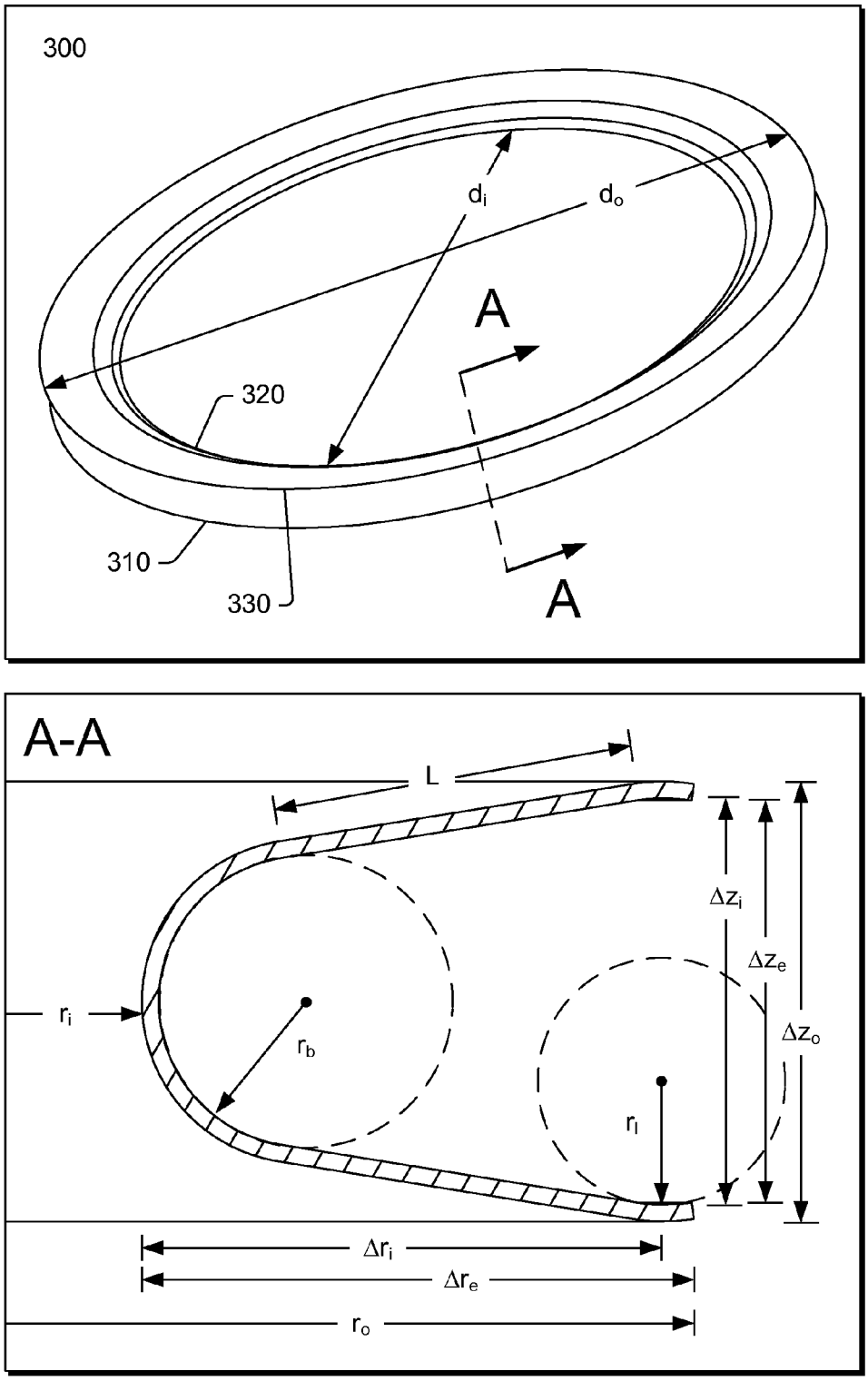
FIG. 3 is a series of views of an example of a seal optionally suitable for use with the turbocharger of FIG. 2.

FIG. 3 shows a perspective view and a cross-sectional view along a line A-A of an example of a seal 300, which may be formed as a contiguous ring or optionally with overlapping ends. The seal 300 may be defined with respect to a cylindrical coordinate system having radial, axial and azimuthal coordinates r, z and Θ, respectively. In the example of FIG. 3, the seal 300 includes a lower lip 310 that leads to a wall 320 that extends to an upper lip 330. As shown, the wall 320 includes a bend, for example, defined by a bend radius $r_b$. The wall 320 also includes a lower length and an upper length (see, e.g., the dimension "L") that extend from the bend to the lower lip 310 and the upper lip 330, respectively. As an example, each of the lips 310 and 330 may be defined in part by a lip radius $r_l$ or respective lip radii (e.g., where the two radii differ).

In the example of FIG. 3, the seal 300 includes various dimensions, such as, for example, an inner diameter $d_i$, an outer diameter $d_o$, a radial distance between the inner diameter $d_i$ and a lip $\Delta r_i$, a radial distance between the inner diameter and an edge $\Delta r_e$, an axial distance between lips $\Delta z_o$, an axial distance between edges $\Delta z_e$ and an axial distance between inner sides of lips $\Delta z_i$, for example, which may define a thickness of the material that forms the seal 300.

As an example, the seal 300 may be defined as having a C-shape or a U-shape. As an example, the seal 300 may be defined as being elongated, for example, by having a width to height aspect ratio of a cross-section that is greater than about 1. For example, the cross-sectional view along the line A-A shows the seal 300 as including an aspect ratio of about 1.2 (e.g., $\Delta r_e$ is greater than $\Delta z_o$). As an example, a seal may be defined as having an offset C-shape, for example, where one lip includes a diameter greater than another lip.

In the example of FIG. 3, the lengths that extend from the radius of the seal 300 may be straight or, for example, curved. As an example, the angles of such lengths may differ from those shown in FIG. 3, for example, an angle may direct a length above horizontal (e.g., greater than about 0 degrees) and may be in a range from about 0 degrees to about 45 degrees or more. As an example, angles for an upper length and a lower length as they extend from a radius of a seal may be approximately equal. As an example, an upper length and a lower length of a seal may be approximately equal in length. As an example, a lower lip and an upper lip of a seal may be located approximately at the same diameter and offset by an axial height. As an example, a lower lip and an upper lip of a seal may be located at different diameters (e.g., radially offset) and offset by an axial height.

As mentioned, a seal may be formed by a stamping process, for example, where a sheet of material is stamped and optionally cut to form a seal such as the seal 300 of FIG. 3. As another example, a rolling process may be implemented to shape material from a roll, which may be cut into pieces. For example, a rolling process may form pieces with ends that can form a ring, optionally with overlap.

Figure 4:
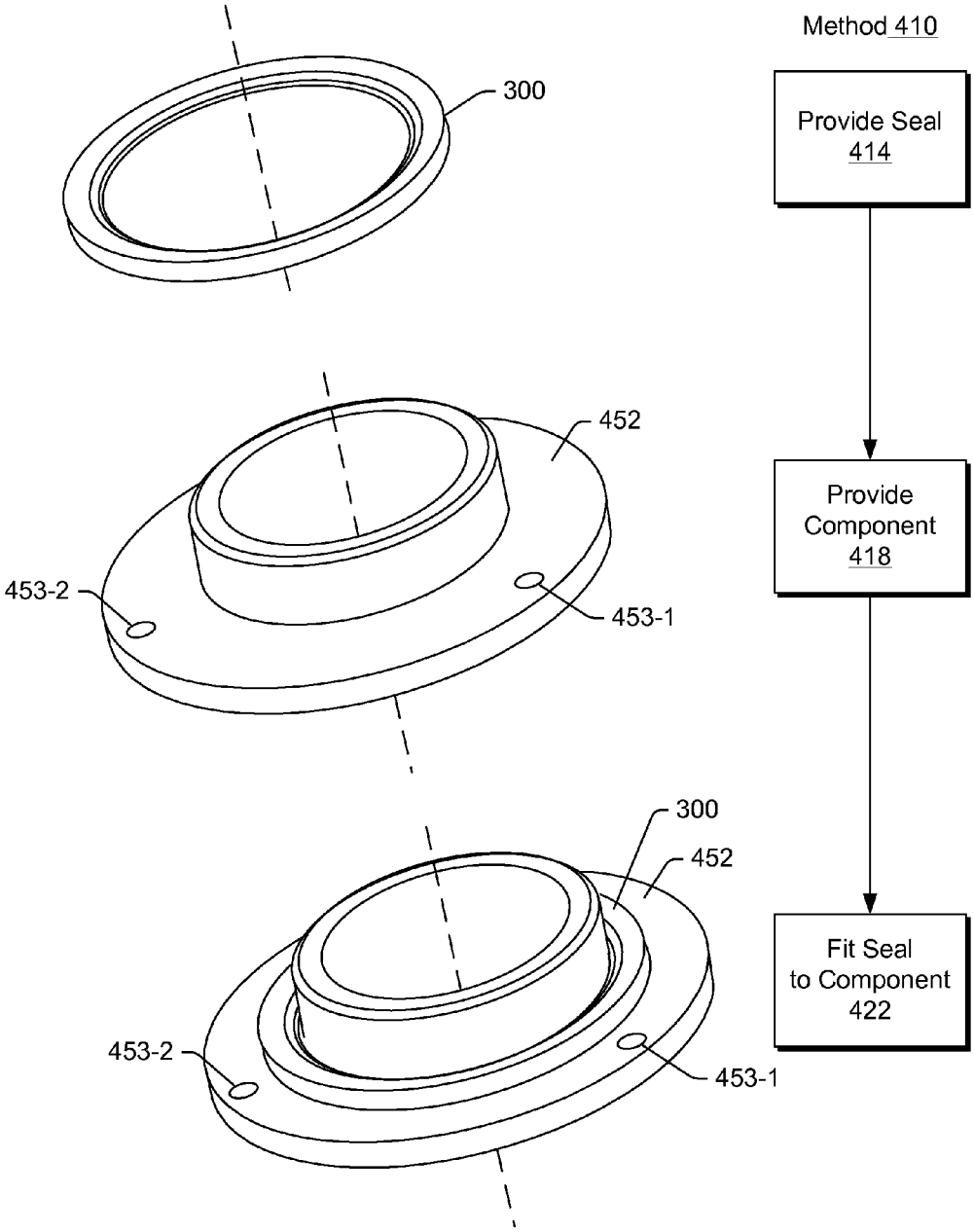
FIG. 4 is a diagram of an example of a method and perspective views of the seal of FIG. 3 and a shroud component.

FIG. 4 shows an example of a method 410 that includes a provision block 414 for providing a seal, a providing block 418 for providing a component and a fit block 422 for fitting the seal to the component. FIG. 4 also shows an example of an assembly method where the seal 300 is provided along with a component 452 that may include mounting features 453-1 and 453-2 (e.g., an optionally one or more additional mounting features). As shown, the seal 300 may be fit with respect to a cylindrical portion of the component 452 to seat the seal 300 on an annular portion of the component 452, which includes the mounting features 453-1 and 453-2. In the example of FIG. 4, an outer diameter of the seal 300 is less than a diameter of the mounting features; however, the outer diameter of the seal 300 is positioned radially outwardly away from the cylindrical portion of the component 452 in a manner that locates a lower lip of the seal 300 more closely to the mounting features 453-1 and 453-2. As an example, the seal 300 may contact a housing along an upper lip and contact the component 452 along a lower lip. In such an example, where the component 452 is supported by spacers, mounts, etc. that cooperate with the mounting features 453-1 and 453-2, the shape of the seal 300 may help to diminish risk of bending, deformation, etc. of the component 452. As an example, a seal may help to diminish risk of bending, deformation, etc. of one or more mounts that support a shroud component.

As an example, a method can include providing a C-shaped seal that includes a width to height ratio greater than approximately 1, an inner diameter and an outer diameter; providing a shroud component that includes an annular portion and a cylindrical portion; fitting the C-shaped seal on to the shroud component to seat the C-shaped seal about the cylindrical portion and in contact with the annular portion to form a sub-assembly; and inserting the sub-assembly into a turbine housing to contact the C-shaped seal with an axial face of the turbine housing. Such a method may further include operating a turbocharger that includes the turbine housing and sub-assembly where the C-shape seal acts to seal against exhaust leakage within the turbine housing and, for example, acts to direct forces that occur during operation of the turbocharger.

Figure 5:
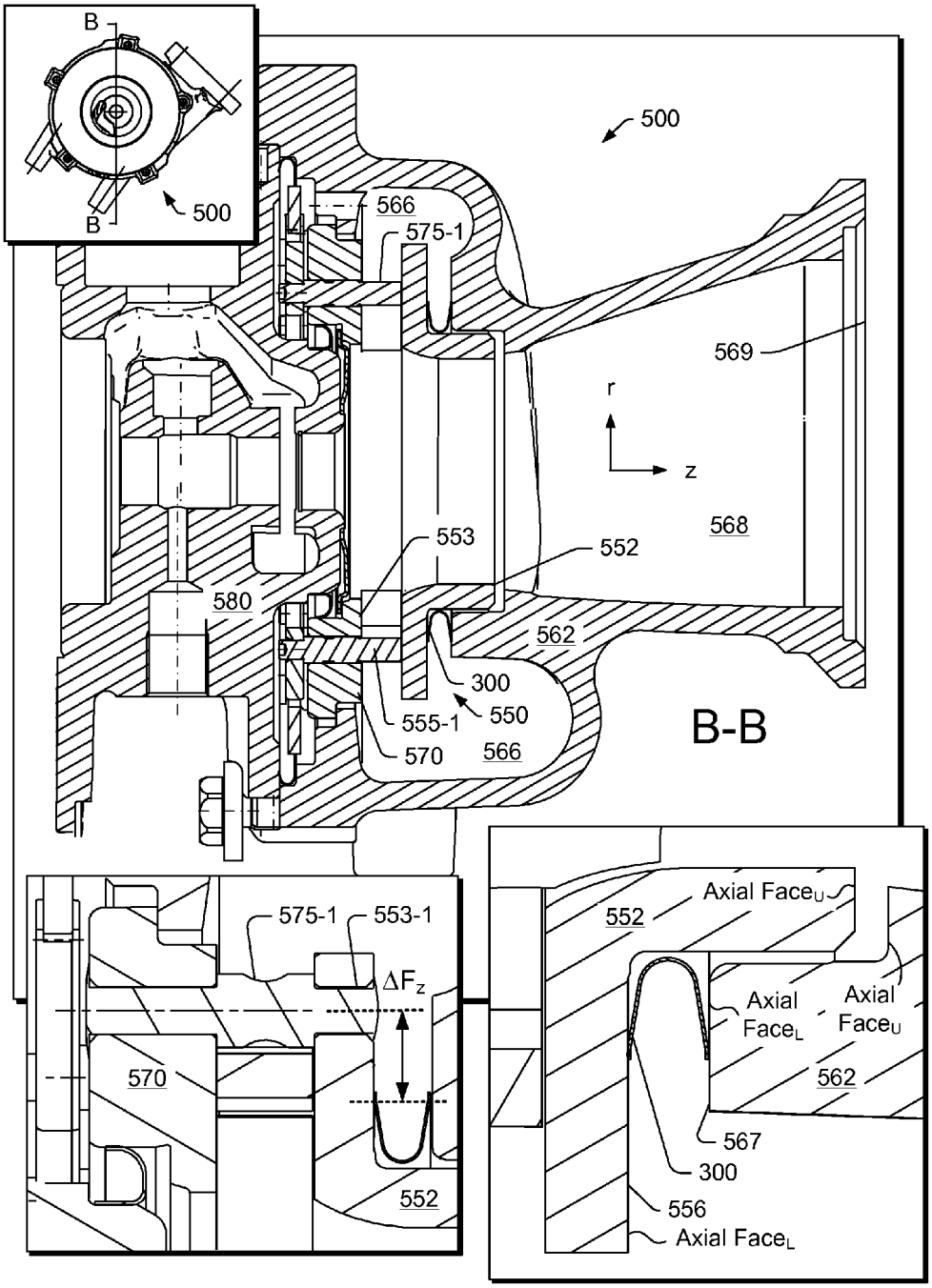
FIG. 5 is a cross-sectional view of a portion of a turbocharger assembly that includes the seal of FIG. 3 and FIG. 4.

FIG. 5 shows a plan view of a portion of an assembly 500, a cross-sectional view of the portion of an assembly 500 (along line B-B) and two enlarged cross-sectional views where various components include reference numerals in the 500s, which may generally correspond to reference numerals in the 200s of the example of FIG. 2. For example, as for the assembly 200 of FIG. 2, the assembly 500 includes a cartridge 550 disposed between a turbine housing 562 and a center housing 580, however, the assembly 500 now includes the seal 300 (e.g., in a compression state). In FIG. 5, the assembly 500 is shown as including a volute 566, as defined at least in part by the turbine housing 562, a passage 568, as defined at least in part by the turbine housing 562, a vane 555-1 (e.g., with a vane post) disposed in an exhaust passage defined by the cartridge 550 (e.g., a passage defined by the component 552 and another component 553 of the cartridge 550) where the passage 568 extends between the volute 566 and an opening 569 of the turbine housing 562.

The example of FIG. 5 also shows a radial distance $\Delta F_z$ with respect to force transmission, for example, for axial components of force at contact points of the seal 300 with respect to the shroud component 552 and the turbine housing 562 and a mount 575-1 as received by a mounting feature 553-1 of the shroud component 552. In such an example, the mount 575-1 may be or act as a spacer to define an axial clearance between an annular component 570 and the shroud component 552.

In the example of FIG. 5, the seal 300 is shown as contacting the shroud component 552 along a lower axial face of an outer surface 556 of the shroud component 552. The axial face may be defined as a lower axial face of an annular portion of the shroud component 552 where, for example, a cylindrical portion of the shroud component 552 includes an upper annular face (see, e.g., Axial $Face_L$ and Axial $Face_U$ of the shroud component 552). As shown in the example of FIG. 5, the turbine housing 562 also includes a lower axial face along a surface 567 and an upper axial face (see, e.g., Axial $Face_L$ and Axial $Face_U$ of the turbine housing 562).

As mentioned, exhaust leakage between components such as the shroud component 552 and the turbine housing 562 may be detrimental to performance of an exhaust turbine. Accordingly, in the example of FIG. 5, the seal 300 is disposed between the shroud component 552 and the turbine housing 562 in an effort to avoid such exhaust leakage (e.g., to help ensure exhaust flows from the volute 566 via a throat or throats to a turbine wheel space).

As shown, with respect to various coordinates, clearances between a surface 556 of the shroud component 552 and a surface 567 of the turbine housing 562 define a passage in which the seal 300 may be at least in part disposed. In the example of FIG. 5, the shroud component 552 may be referred to as a "pipe" as it has a cylindrical end that forms an outlet for exhaust downstream blades of a turbine wheel. While referred to as a shroud component, because it can form a shroud for a turbine wheel along an inner surface, the component 552 may be referred to as an insert as it is partially inserted into a recess defined by the turbine housing 562.

As an example, the seal 300 can substantially maintain its position during service while contacting the shroud component 552 and contacting the turbine housing 562.

As an example, a seal may optionally be configured to be press-fit (e.g., interference fit) along an inner diameter (e.g., with respect to a shroud component). As an example, a clearance may exist between an inner diameter of a seal and an outer diameter of a cylindrical portion of a shroud component. In such an example, the clearance may allow for some movement of an inner diameter of the seal, for example, responsive to compression, temperature changes, etc. As an example, the seal 300 may expand or contract while still acting as a hindrance for flow of exhaust from the volute 566 to the passage 568 in the space defined by the surfaces 556 and 567 of the components 552 and 562, respectively.

Figure 6:
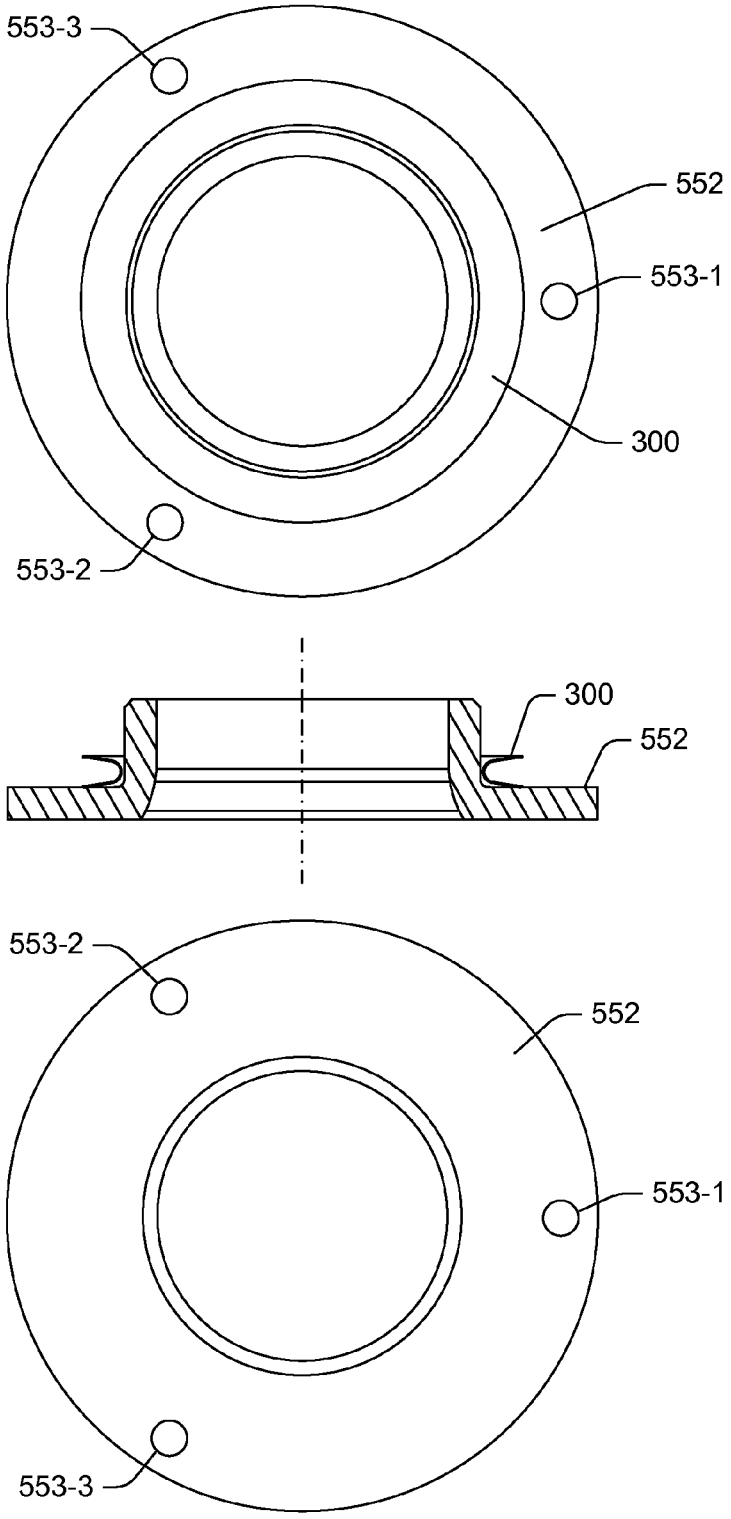
FIG. 6 is a series of views of the seal of FIG. 3 and a shroud component.

FIG. 6 shows plan views and a cross-sectional view of an example of the seal 300 and the shroud component 552 of FIG. 5, for example, as including three mounting features 553-1, 553-2 and 553-3. As shown, the seal 300 contacts the shroud component 552 in a manner that acts to displace forces away from a cylindrical portion of the shroud component 552 and closer to the mounting features 553-1, 553-2 and 553-3 of the shroud component 552.

Figure 7:
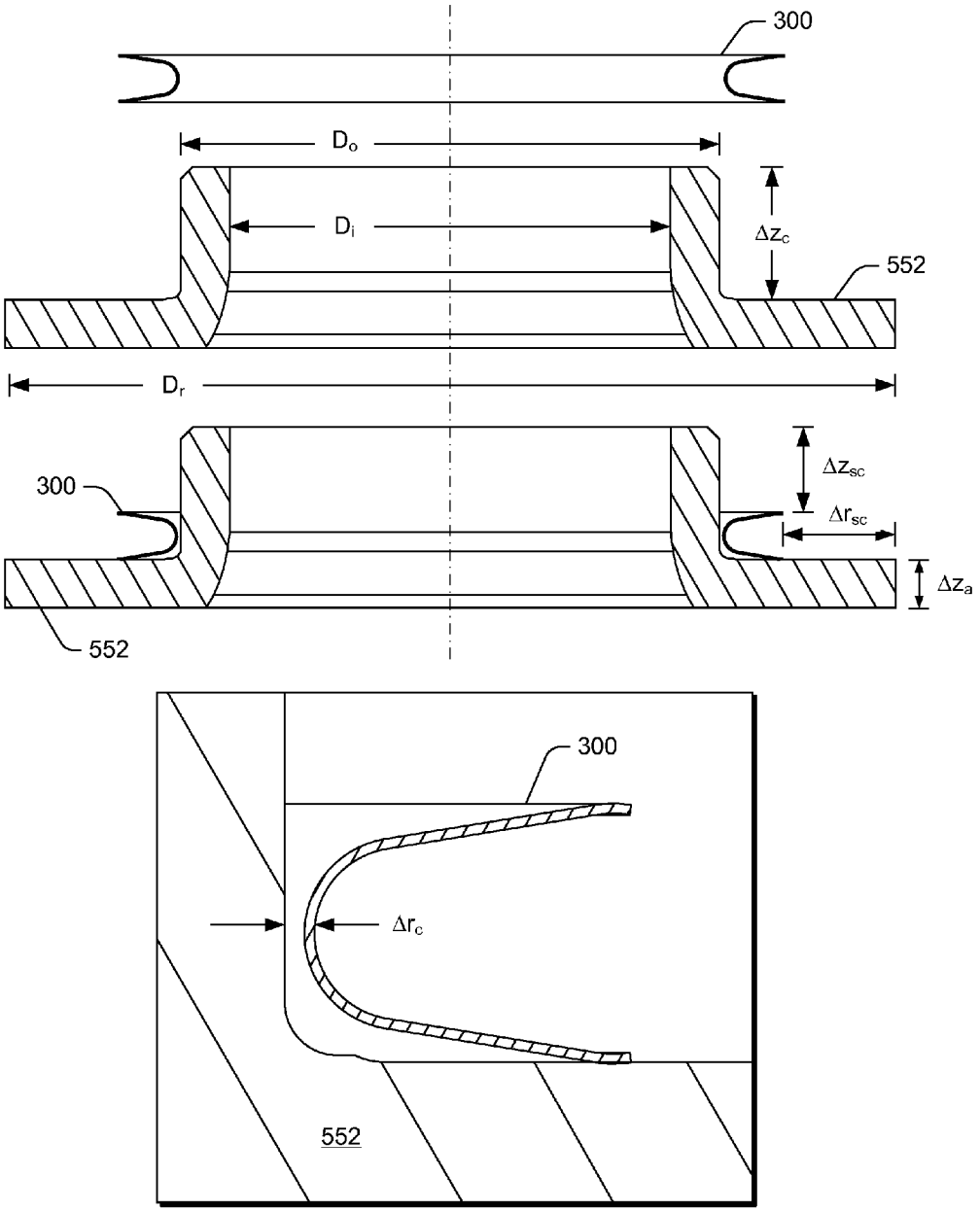
FIG. 7 is a series of views of the seal of FIG. 3 and a shroud component.

FIG. 7 shows a series of cross-sectional views of an example of the seal 300 and the shroud component 552 of FIG. 5. In the example of FIG. 7, the shroud component 552 is shown as including various dimensions such as, for example, an outer diameter of a cylindrical portion $D_o$, an inner diameter of a cylindrical portion $D_i$, an outer diameter of an annular portion $D_r$ and a thickness $\Delta z_a$ of the annular portion.

As shown in the example of FIG. 7, an axial height exists between the lower axial face of the annular portion of the shroud component 552 and an upper axial face of the cylindrical portion of the shroud component 552. The seal 300 may include an axial height that is less than the axial height $\Delta z_c$, for example, such that an axial distance $\Delta z_{sc}$ exists between an upper lip of the seal 300 and the upper axial face of the cylindrical portion of the shroud component 552. Also shown in the example of FIG. 7 is a radial clearance $\Delta r_c$ between an inner diameter of the seal 300 and an outer diameter of the cylindrical portion of the shroud component 552 and a radial distance $\Delta r_{sc}$, for example, between an outer radius of the seal 300 and an outer edge of the shroud component 552.

Figure 8:
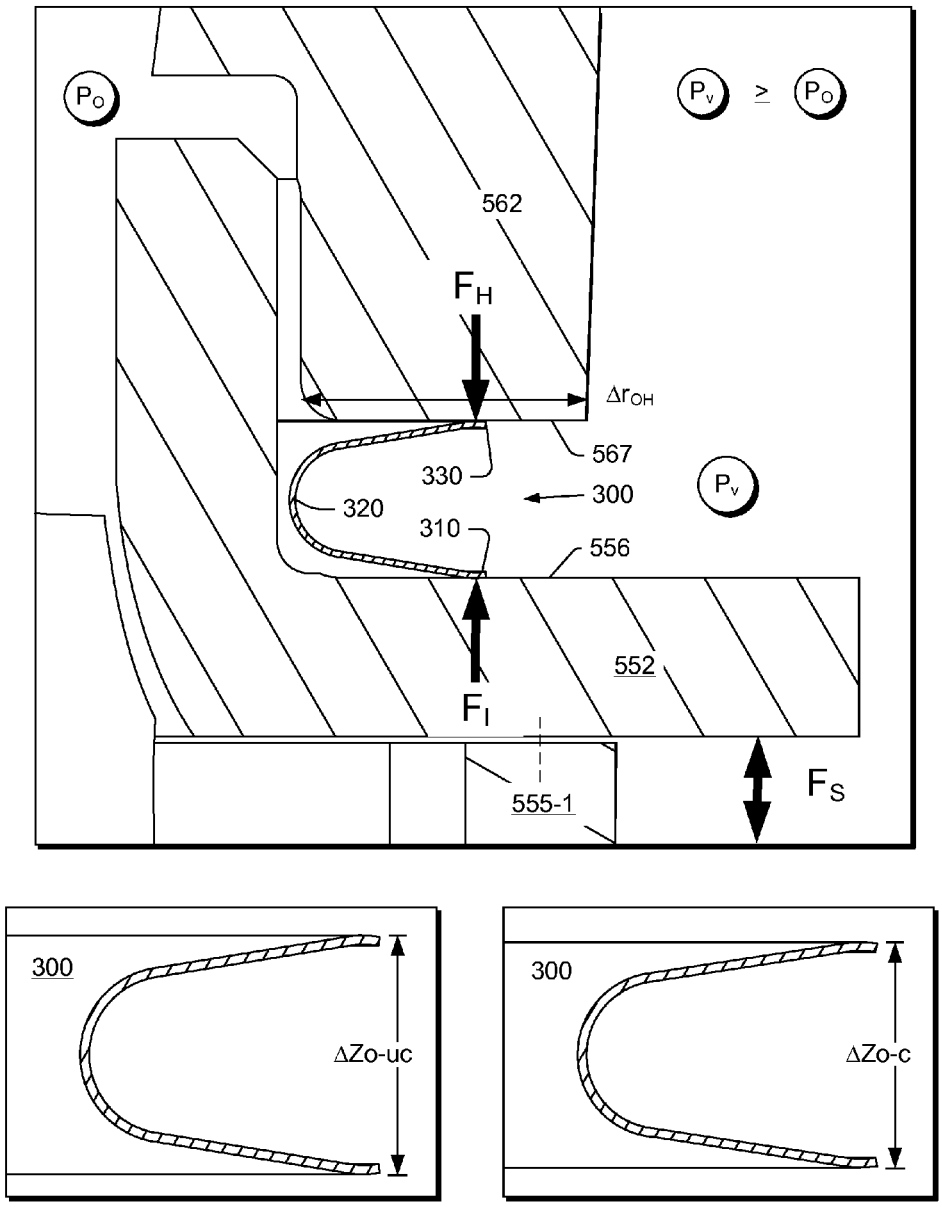
FIG. 8 is a series of views of the seal of FIG. 3 included in an assembly.

FIG. 8 shows a series of cross-sectional views of various components including the seal 300 in an uncompressed state (e.g., free standing state) and in a compressed state (e.g., an assembled state). As shown in FIG. 8, the seal 300 may be positioned with respect to a shroud component 552 and a turbine housing 562 such that contacts are formed between the lower lip 310 of the seal 300 and a surface 556 of the shroud component 552 and formed between the upper lip 330 of the seal 300 and a surface 567 of the turbine housing 562. In the example of FIG. 8, the surface 567 may be defined in part by an overhang dimension such as $\Delta r_{OH}$, which may be defined in part by a volute side surface of the turbine housing 562.

In FIG. 8, arrows represent approximate force vectors that may be applied to the seal 300 via the lower lip 310 and the upper lip 330. Another force vector is shown, for example, to represent support for the shroud component 552 (e.g., at an approximate mount or support position). In the example, of FIG. 8, the upper lip 330 of the seal 300 is positioned with respect to the overhang (e.g., lower axial face) of the turbine housing 562. The overhang may include a mid-point, for example, where the seal 300 is configured to contact the turbine housing 562 radially outwardly from the mid-point (e.g., between the mid-point and a volute side surface of the turbine housing 562). As an example, a seal may be elongated to locate contact points radially outwardly from a center axis of a turbine housing and closer to a volute defined at least in part by the turbine housing.

FIG. 8 also shows a vane 555-1, for example, as associated with a post or axel that defines a pivot axis for the vane. As mentioned, the seal 300 may be arranged to reduce risk of deformation of a shroud component, for example, to reduce risk of sticking, binding, friction, etc. of one or more vanes.

FIG. 8 further shows volute and outlet pressures $P_V$ and $P_O$, respectively. As an example, the seal 300 may act to prevent flow of exhaust from a higher pressure side at pressure $P_V$ to a lower pressure side at pressure $P_O$. As described in various examples, a seal may act to seal and to direct forces in a manner beneficial to operation of a turbocharger such as, for example, a turbocharger that includes a variable geometry turbine unit.

Figure 9:
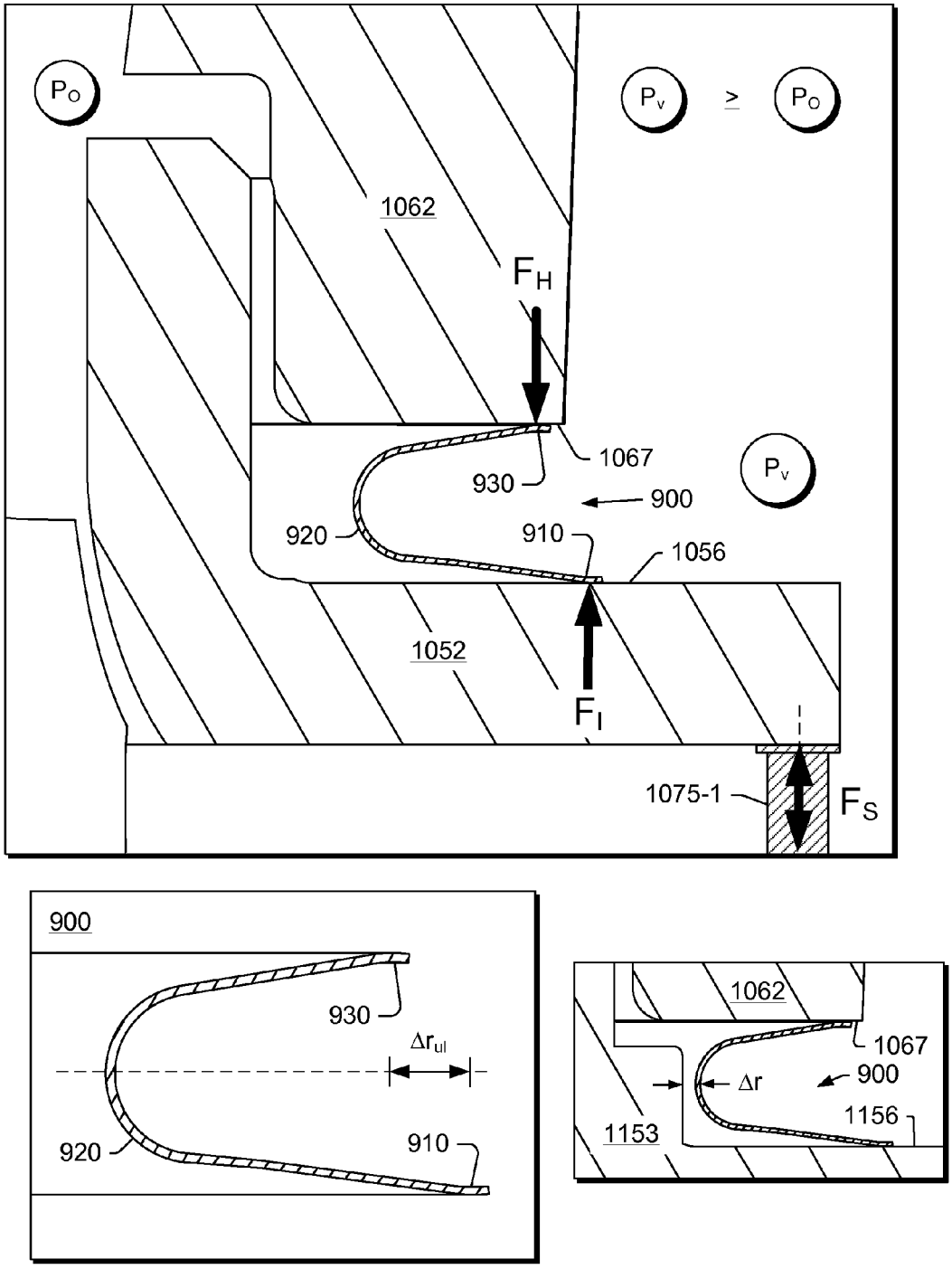
FIG. 9 is a series of views of an example of a seal included in an example of an assembly and an example of a shroud component.

FIG. 9 shows a series of cross-sectional views of various components including an example of a seal 900 and an example of a shroud component 1152. As shown in FIG. 9, the seal 900 may be positioned with respect to a shroud component 1052 and a turbine housing 1062 such that contacts are formed between the lower lip 910 of the seal 900 and a surface 1056 of the shroud component 1052 and formed between the upper lip 930 of the seal 900 and a surface 1067 of the turbine housing 1062. In the example of FIG. 9, the surface 1067 may be defined in part by an overhang dimension, which may be defined in part by a volute side surface of the turbine housing 1062.

In FIG. 9, arrows represent approximate force vectors that may be applied to the seal 900 via the lower lip 910 and the upper lip 930. Another force vector is shown, for example, as corresponding to a support 1075-1 for the shroud component 1052. In the example of FIG. 9, the support 1075-1 may abut a surface of the shroud component 1052 or, for example, extend partially into the shroud component 1052 or vice versa. As another example, a support may extend to an end of a shroud component. As an example, a support may optionally be integral to the shroud component (e.g., as a unitary component that include a plurality of supports).

In the example, of FIG. 9, the upper lip 930 of the seal 900 is positioned with respect to the overhang (e.g., lower axial face) of the turbine housing 1062. The overhang may include a mid-point, for example, where the seal 900 is configured to contact the turbine housing 1062 radially outwardly from the mid-point (e.g., between the mid-point and a volute side surface of the turbine housing 1062). As an example, a seal may be elongated to locate contact points radially outwardly from a center axis of a turbine housing and closer to a volute defined at least in part by the turbine housing.

In the example of FIG. 9, the lower lip 910 is disposed at a radius greater than that of the upper lip 930. As an example, the lower lip 910 and the upper lip 930 may extend from the wall 920 at different angles, with different lengths, etc. In the example of FIG. 9, the lower lip 910 contacts the surface 1056 of the shroud component 1052 at a position radially outwardly from the overhang of the turbine housing 1062. As shown, by having a lower lip that extends radially outwardly from an upper lip, force along an overhang portion of a turbine housing may be transferred to or received from a portion of a shroud component, which may include a plurality of supports (e.g., where the lower lip is positioned at a radial position closer to the support than the upper lip). As an example, a lower lip of a seal may extend radially into a volute, for example, a volute defined at least in part by a turbine housing (e.g., while contacting a surface of an annular portion of a shroud component).

As an example, vanes may be located radially inwardly from a radial position of the support 1075-1. Such vanes may include respective posts or axels that define pivot axes for the vanes. As mentioned, the seal 900 may be arranged to reduce risk of deformation of a shroud component, for example, to reduce risk of sticking, binding, friction, etc. of one or more vanes.

As an example, FIG. 9 also shows a shroud component 1152 that includes a stepped wall or shoulder, for example, that extends radially outwardly from a cylindrical portion of the shroud component 1152 that includes a surface 1156, for example, that may contact a lower lip of a seal (see, e.g., the lower lip 910 of the seal 900). In such an example, the outer diameter of the shroud component 1152 is increased over a portion of its axial height such that the enlarged outer diameter portion may decrease clearance (see, e.g., $\Delta r$) with respect to a seal, for example, to limit possible movement of the seal (e.g., about a seal axis that is approximately parallel to a rotational axis of a turbine wheel or a central axis of a cylindrical portion of a shroud component). For example, depending on a balance of forces (e.g., pressure, vibration, compression, friction, etc.), a seal may experience lesser or greater frictional force with respect to a shroud component and a turbine housing. As an example, one or more locating features may be provided for physically limiting displacement of a seal (e.g., displacement of a seal axis with respect to a central axis of a shroud surface, etc.). While the example of FIG. 9 shows a particular feature, as an example, a feature may be a component that is disposed in an annular space defined by a shroud component, a turbine housing and a seal, for example, consider a component that may optionally be compressible along a radial dimension to help balance forces and locate the seal.

FIG. 9 further shows volute and outlet pressures $P_V$ and $P_O$, respectively. As an example, the seal 900 may act to prevent flow of exhaust from a higher pressure side at pressure $P_V$ to a lower pressure side at pressure $P_O$. As described in various examples, a seal may act to seal and to direct forces in a manner beneficial to operation of a turbocharger such as, for example, a turbocharger that includes a variable geometry turbine unit.

As an example, a turbine assembly for a turbocharger can include a turbine wheel that includes a base, a nose, blades, and a rotational axis that extends from the base to the nose; a turbocharger shaft operatively coupled to the turbine wheel; an annular component that includes an opening that receives at least a portion of the turbine wheel; a shroud component that includes an axis aligned with the rotational axis of the turbine wheel and an annular portion and a cylindrical portion that include an outer surface and an inner shroud surface where the outer surface includes a lower axial face and an upper axial face; mounts that extend from the annular component to locations at the shroud component where the mounts form an axial clearance between the annular component and the shroud component; a turbine housing that includes an axis aligned with the rotational axis of the turbine wheel, a lower axial face, an upper axial face and an inner surface that extends between the lower axial face and the upper axial face; and a C-shaped seal that includes an inner diameter, an outer diameter, an axis aligned parallel to the rotational axis of the turbine wheel, a lower lip that contacts the lower axial face of the outer surface of the shroud component along the annular portion of the shroud component, an upper lip that contacts the lower axial face of the inner surface of the turbine housing, and a wall portion that extends between the lower lip and the upper lip. As an example, a C-shaped seal may be elongated (e.g., width greater than height in cross-section), include radially offset lips (e.g., or edges), etc.

As an example, a seal can include a wall portion with a radius, an upper length that extends from an upper end of the radius to an upper lip, and a lower length that extends from a lower end of the radius to a lower lip. In such an example, the upper length and the lower length may be straight lengths. As an example, a radius of a seal may include a mid-point that defines an inner diameter of the seal.

As an example, a seal may include a free-standing axial dimension between a lower lip and an upper lip and a compressed axial dimension between the lower lip and the upper lip that is less than the free-standing axial dimension.

As an example, a seal can include a lower lip diameter and an upper lip diameter. In such an example, an assembly may include locations of mounts at a shroud component that include a common mount diameter. In such an example, an inner diameter of a C-shaped seal may be greater than an outer diameter of a cylindrical portion of the shroud component where, for example, the lip diameters are greater than the inner diameter of the C-shaped seal and where the common mount diameter is greater than the lip diameters. As an example, a lower lip diameter may be about 75 percent or more of such a common mount diameter. As an example, a lower lip diameter may be approximately 80 or more of such a common mount diameter.

As an example, a lower lip and an upper lip of a seal may have a common lip diameter. As an example, locations of mounts at a shroud component may have a common mount diameter. As an example, an inner diameter of a C-shaped seal may be greater than an outer diameter of a cylindrical portion of a shroud component, where a common lip diameter is greater than an inner diameter of the C-shaped seal and where a common mount diameter is greater than the common lip diameter. In such an example, the C-shaped seal may direct contact forces axially between the shroud component and a turbine housing, for example, where the shroud component directs forces due to contact with the lower lip of the C-shaped seal to mounts.

As an example, a turbine assembly can include vanes disposed between an annular component and a shroud component where each of the vanes includes an axial post and where, for example, the axial posts have a common post diameter (e.g., about a rotational axis of a turbine wheel). In such an example, a lower lip and an upper lip of a C-shaped seal may include a common lip diameter that is approximately the common post diameter or, for example, at least a lower lip diameter that is approximate the common post diameter.

As an example, for a variable geometry turbine unit with vanes, each of the vanes may include a planar upper surface disposed approximately parallel to a lower surface of an annular portion of a shroud component.

As an example, a C-shaped seal may include an elongated C-shape defined by a width to height ratio greater than approximate 1 or greater than approximate 1.1. As an example, such a ratio may be approximately 1.8. As an example, a C-shaped seal can include an open side and a closed side where the open side faces radially outward.

As an example, a turbocharger assembly can include a compressor wheel disposed in a compressor housing; a center housing that includes a bore and a bearing system disposed in the bore, the compressor housing attached to the center housing; a shaft and turbine wheel assembly that includes a shaft portion, a turbine wheel portion, and a rotational axis wherein the compressor wheel is attached to the shaft portion and the shaft portion is rotatably supported by the bearing system disposed in the bore of the center housing; a variable geometry cartridge positioned with respect to the center housing where the variable geometry cartridge includes a shroud component that includes an axis aligned with the rotational axis of the turbine wheel, an inner shroud surface, a lower axial face, an upper axial face and an outer surface that extends between the lower axial face and the upper axial face; a turbine housing attached to the center housing where the turbine housing includes an axis aligned with the rotational axis of the turbine wheel, a lower axial face, an upper axial face and an inner surface that extends between the lower axial face and the upper axial face; and a C-shaped seal that includes an inner diameter, an outer diameter, an axis aligned parallel to the rotational axis of the turbine wheel, a lower lip that contacts the lower axial face of the shroud component, an upper lip that contacts the lower axial face of the turbine housing, and a wall portion that extends between the lower lip and the upper lip.

Although some examples of methods, devices, systems, arrangements, etc., have been illustrated in the accompanying Drawings and described in the foregoing Detailed Description, it will be understood that the example embodiments disclosed are not limiting, but are capable of numerous rearrangements, modifications and substitutions.

What is claimed is:

1. A turbine assembly for a turbocharger comprising:

a turbine wheel that comprises a base, a nose, blades, and a rotational axis that extends from the base to the nose;

a turbocharger shaft operatively coupled to the turbine wheel;

an annular component that comprises an opening that receives at least a portion of the turbine wheel;

a shroud component that comprises an axis aligned with the rotational axis of the turbine wheel and an annular portion and a cylindrical portion that comprise an outer surface and an inner shroud surface wherein the outer surface comprises a lower axial face and an upper axial face;

mounts that extend from the annular component to locations at the shroud component wherein the mounts form an axial clearance between the annular component and the shroud component;

a turbine housing that comprises an axis aligned with the rotational axis of the turbine wheel, a lower axial face, an upper axial face and an inner surface that extends between the lower axial face and the upper axial face;

vanes wherein each of the vanes comprises an axial post that comprise a common post radius that is less than respective radii of the locations of the mounts at the shroud component as measured from the axis of the shroud component; and a C-shaped seal that comprises an inner diameter, an outer diameter, an axis aligned parallel to the rotational axis of the turbine wheel, a lower lip that contacts the lower axial face of the outer surface of the shroud component along the annular portion of the shroud component, an upper lip that contacts the lower axial face of the inner surface of the turbine housing, and a wall portion that extends between the lower lip and the upper lip, wherein at least the lower lip of the C-shaped seal comprises a lip radius that is approximately the common post radius or greater.

2. The turbine assembly of claim 1 wherein the wall portion comprises a radiused portion ($r_b$), an upper length that extends from an upper end of the radiused portion ($r_b$) to the upper lip, and a lower length that extends from a lower end of the radiused portion ($r_b$) to the lower lip.

3. The turbine assembly of claim 2 wherein the upper length and the lower length are straight lengths.

4. The turbine assembly of claim 2 wherein the radiused portion ($r_b$) comprises a mid-point that defines the inner diameter of the C-shaped seal.

5. The turbine assembly of claim 1 wherein the C-shaped seal comprises a free-standing axial dimension between the lower lip and the upper lip.

6. The turbine assembly of claim 5 wherein the C-shaped seal comprises a compressed axial dimension between the lower lip and the upper lip that is less than the free-standing axial dimension.

7. The turbine assembly of claim 1 wherein the lower lip comprises a lower lip diameter and the upper lip comprise an upper lip diameter.

8. The turbine assembly of claim 7 wherein the locations of the mounts at the shroud component comprise a common mount diameter.

9. The turbine assembly of claim 8 wherein the inner diameter of the C-shaped seal is greater than an outer diameter of the cylindrical portion of the shroud component, wherein the lip diameters are greater than the inner diameter of the C-shaped seal and wherein the common mount diameter is greater than the lip diameters.

10. The turbine assembly of claim 9 wherein the C-shaped seal directs contact forces axially between the shroud component and the turbine housing.

11. The turbine assembly of claim 10 wherein the shroud component directs forces due to contact with the lower lip of the C-shaped seal to the mounts.

12. The turbine assembly of claim 1 wherein each of the vanes comprises a planar upper surface disposed approximately parallel to a lower surface of the annular portion of the shroud component.

13. The turbine assembly of claim 1 wherein the C-shaped seal comprises an elongated C-shape defined by a width to height ratio greater than or equal to 1.

14. The turbine assembly of claim 13 wherein the width to height ratio is greater than or equal to 1.1.

15. The turbine assembly of claim 13 wherein the width to height ratio is greater than or equal to 1.8.

16. The turbine assembly of claim 1 wherein the C-shaped seal comprises an open side and a closed side wherein the open side faces radially outward.

17. A method comprising:

providing a C-shaped seal that comprises a width to height ratio greater than or equal to 1, an inner diameter and an outer diameter wherein the C-shaped seal comprises a wall portion defined by a radius of curvature and wherein the wall portion comprises an upper length that extends from an upper end of the wall portion to an upper lip and a lower length that extends from a lower end of the wall portion to a lower lip;

providing a cartridge that comprises an axis, a shroud component, mounts and vanes wherein the shroud component comprises an annular portion and a cylindrical portion and wherein the mounts comprise mount radii measured from the axis, and wherein each of the vanes comprises an axial post that comprise a common post radius measured from the axis that is less than the mount radii;

fitting the C-shaped seal on to the shroud component to seat the C-shaped seal about the cylindrical portion and in contact with the annular portion to form a sub-assembly; and inserting the sub-assembly into a turbine housing to contact the C-shaped seal with an axial face of the turbine housing wherein the axial face extends from an inner radius to an outer radius at a volute and wherein at least the lower lip of the C-shaped seal comprises a lip radius that is approximately the common post radius or greater.

18. A turbocharger assembly comprising:

a compressor wheel disposed in a compressor housing;

a center housing that comprises a bore and a bearing system disposed in the bore, the compressor housing attached to the center housing;

a shaft and turbine wheel assembly that comprises a shaft portion, a turbine wheel portion, and a rotational axis wherein the compressor wheel is attached to the shaft portion and the shaft portion is rotatably supported by the bearing system disposed in the bore of the center housing;

a variable geometry cartridge positioned with respect to the center housing wherein the variable geometry cartridge comprises a shroud component that comprises an axis aligned with the rotational axis of the turbine wheel, an inner shroud surface, a lower axial face, an upper axial face and an outer surface that extends between the lower axial face and the upper axial face and wherein the variable geometry cartridge comprises mounts and vanes wherein each of the vanes comprises an axial post that comprise a common post radius that is less than respective radii of the locations of the mounts at the shroud component as measured from the axis of the shroud component;

a turbine housing attached to the center housing wherein the turbine housing comprises an axis aligned with the rotational axis of the turbine wheel, a lower axial face, an upper axial face and an inner surface that extends between the lower axial face and the upper axial face; and a C-shaped seal that comprises an inner diameter, an outer diameter, an axis aligned parallel to the rotational axis of the turbine wheel, a lower lip that contacts the lower axial face of the shroud component, an upper lip that contacts the lower axial face of the turbine housing, and a wall portion that extends between the lower lip and the upper lip, wherein at least the lower lip of the C-shaped seal comprises a lip radius that is approximately the common post radius or greater.

* * * * *